US008031137B2

(12) United States Patent
Kang

(10) Patent No.: US 8,031,137 B2
(45) Date of Patent: Oct. 4, 2011

(54) PLASMA DISPLAY DEVICE AND DRIVING METHOD THEREOF

(75) Inventor: Tae-Kyoung Kang, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1117 days.

(21) Appl. No.: 11/776,910

(22) Filed: Jul. 12, 2007

(65) Prior Publication Data

US 2008/0117123 A1 May 22, 2008

(30) Foreign Application Priority Data

Nov. 17, 2006 (KR) ..... 10-2006-0114087

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS 7,612,741 B2 * 11/2009 Kim ..... 345/67
2003/0214463 A1 * 11/2003 Lim et al. ..... 345/60
2005/0168407 A1 * 8/2005 Lee et al. ..... 345/60
2007/0132666 A1 * 6/2007 Lee ..... 345/60
2010/0128023 A1 * 5/2010 Shoji et al. ..... 345/214

FOREIGN PATENT DOCUMENTS

KR 2005-118867 12/2005
KR 2005-121920 12/2005
KR 2006-59100 6/2006

* cited by examiner

*Primary Examiner* — Richard Hjerpe
*Assistant Examiner* — Jeffrey Parker
(74) *Attorney, Agent, or Firm* — Christie, Parker & Hale, LLP

(57) ABSTRACT

When a current frame of a video expresses only grayscales less than a reference grayscale, a sustain pulse applying period and a holding period are alternately provided in a sustain period of at least one subfield having a weight greater than a reference weight in all of the discharge cells of a plasma display panel, thereby reducing power consumption in the plasma display panel. In the sustain pulse applying period, sustain pulses alternately having a first voltage and a second voltage less than the first voltage are applied in opposite phases to first electrodes and second electrodes of the plasma display panel. In the holding period, the first electrodes and/or the second electrodes are maintained at the first voltage.

18 Claims, 4 Drawing Sheets

PLASMA DISPLAY DEVICE AND DRIVING METHOD THEREOF

CROSS-REFERENCE TO RELATED APPLICATIONS

This application claims the benefit of Korean Patent Application No. 2006-114087 filed on Nov. 17, 2006, in the Korean Intellectual Property Office, the disclosure of which is incorporated herein by reference in its entirety.

BACKGROUND OF THE INVENTION

1. Field of the Invention

Aspects of the invention relate to a plasma display device and a driving method thereof.

2. Description of the Related Art

A plasma display device is a flat panel display using a plasma display panel (PDP) that displays characters or images using plasma generated by a gas discharge. The plasma display panel includes, depending on its size, tens to millions of pixels arranged in a matrix.

The plasma display device divides each of a plurality of frames of a video signal into a plurality of subfields each having a grayscale weight for driving the plasma display panel to display grayscales. The grayscale of a discharge cell is determined by the sum of the grayscale weights of the subfields in which the discharge cell is driven to emit light. Each subfield has a reset period, an address period, and a sustain period. The reset period is for initializing the state of each discharge cell to facilitate performing an addressing operation in the discharge cell. The address period is for applying an address voltage to cells that are to be turned on (addressed cells) to generate an address discharge and store wall charges to select cells that are turned on and cells that are not turned on in the panel. The sustain period is for applying sustain pulses to perform a sustain discharge to display an image with the addressed cells.

In general, sustain pulses are applied to the scan electrode and the sustain electrode in the sustain period of each subfield, and a sustain discharge is accordingly generated in the discharge cells that were selected to be cells to be turned on in the address period. That is, sustain pulses alternately having a high level voltage (in general, a Vs voltage) and a low level voltage (in general, a 0V voltage) in opposite phases are applied to the scan electrode and the sustain electrode. A sustain discharge is then generated in discharge cells that have a voltage greater than a discharge firing voltage, i.e., that have a voltage that is the sum of the voltage due to the wall charges formed in the discharge cells that were selected to be cells to be turned on in the address period and the sustain pulse voltage difference. Respective grayscales can be expressed by a combination of grayscale weights of the subfields. Much power is consumed when there are many switching operations for applying a sustain pulse voltage to the scan electrode and the sustain electrode, that is, when many sustain pulses are applied to the scan electrode and the sustain electrode in a subfield.

Also, the plasma display panel (PDP) has a capacitance since the discharge space between the scan electrode and the sustain electrode of the plasma display panel functions as a capacitor. Therefore, reactive power must be supplied to charge the capacitance up to a predetermined voltage each time a sustain pulse is applied to the scan electrode and the sustain electrode, in addition to power that is consumed by the sustain discharge generated by the sustain pulses.

Furthermore, when one frame of the video expresses low grayscales over the entire display screen, or expresses a completely black image in which all of the discharge cells of the entire display screen express a 0 grayscale, undesired sustain pulses are applied in the sustain period of each subfield, further increasing power consumption.

The above information disclosed in this Background of the Invention section is only for enhancement of understanding of the background of the invention, and is not to be construed in any way as an admission that this information is prior art that was known by others in this country before the invention was made.

SUMMARY OF THE INVENTION

Aspects of the invention relate to a plasma display device and a driving method thereof that reduce power consumption when displaying frames of video signals that express only grayscales less than a reference grayscale.

According to an aspect of the invention, a plasma display device includes a plasma display panel, a controller, and a driver. The plasma display panel includes a plurality of first electrode, a plurality of second electrodes extending in a same direction as the first electrode, a plurality of third electrodes crossing the first electrodes and the second electrodes, and a plurality of discharge cells. Each of the discharge cells is located at a respective intersection where one of the third electrodes crosses one of the first electrodes and one of the second electrodes. The controller receives a video signal including a plurality of frames, divides each of the frames of the video signal into a plurality of subfields having respective grayscale weights, each of the subfields including a reset period, an address period, and a sustain period, and outputs control signals to perform a reset operation in the reset period of each of the subfields in accordance with the video signal, to perform an address operation in the address period of each of the subfields in accordance with the video signal, and to perform a sustain operation in the sustain period of each of the subfields in accordance with the video signal. The driver drives the plasma display panels according to the control signals output by the controller. When one of the frames of the video signal expresses only grayscales less than a reference grayscale, the controller outputs a control signal to perform a sustain pulse applying operation in at least one sustain pulse applying period in the sustain period of at least one of the subfields of the one of the frames of the video signal, and to perform a holding operation in at least one holding period in the sustain period of the at least one of the subfields of the one of the frames of the video signal. The sustain pulse applying operation includes applying sustain pulses alternately having a first voltage and a second voltage less than the first voltage in opposite phases to the first electrodes and the second electrodes in the at least one sustain pulse applying period. The holding operation includes maintaining the first electrodes and/or the second electrodes at the first voltage in the at least one holding period.

According to an aspect of the invention, a method of driving a plasma display device is provided. The plasma display device includes a plasma display panel. The plasma display panel includes a plurality of first electrodes, a plurality of second electrodes extending in a same direction as the first electrodes, a plurality of third electrodes crossing the first electrodes and the second electrodes, and a plurality of discharge cells. Each of the discharge cells is located at a respective intersection where one of the third electrodes crosses one of the first electrodes and one of the second electrodes. The method includes receiving a video signal including a plurality of frames; dividing each of the frames of the video signal into a plurality of subfields having respective grayscale weights, each of the subfields including a reset period, an address period, and a sustain period; determining whether one of the frames of the video signal expresses only grayscales less than a reference grayscale; and when one of the frames of the video signal expresses only grayscales less than a reference grayscale, performing a sustain pulse applying operation on the first electrodes and the second electrodes in at least one sustain pulse applying period in the sustain period of at least one of the subfields of the one of the frames of the video signal, and performing a holding operation on the first electrodes and the second electrodes in at least one holding period in the sustain period of the at least one of the subfields of the one of the frames of the video signal. The holding operation includes maintaining the first electrodes and/or the second electrodes at a predetermined voltage in the at least one holding period.

According to an aspect of the invention, a plasma display device includes a plasma display panel and a plasma display panel driving circuit. The plasma display panel includes a plurality of first electrodes, a plurality of second electrodes extending in a same direction as the first electrodes, a plurality of third electrodes crossing the first electrodes and the second electrodes, and a plurality of discharge cells, each of the discharge cells being located at a respective intersection where one of the third electrodes crosses one of the first electrodes and one of the second electrodes. The plasma panel driving circuit receives a video signal including a plurality of frames, divides each of the frames of the video signal into a plurality of subfields having respective grayscale weights, each of the subfields including a reset period, an address period following the reset period, and a sustain period following the address period, and outputs output driving waveforms to drive the first electrodes, the second electrodes, and the third electrodes of the plasma display panel in the reset period, the address period, and the sustain period of each of the subfields to display the video signal. When a current frame of the video signal expresses only grayscales less than a reference grayscale, the sustain period of at least one of the subfields having a weight greater than a reference weight includes at least one sustain pulse applying period in which sustain pulses having opposite phases are applied to the first electrodes and the second electrodes, and at least one holding period in which a predetermined voltage is applied to the first electrodes and/or the second electrodes.

Additional aspects and/or advantages of the invention will be set forth in part in the description that follows and, in part, will be obvious from the description, or may be learned by practice of the invention.

BRIEF DESCRIPTION OF THE DRAWINGS

The above and/or other aspects and advantages of the invention will become apparent and more readily appreciated from the following description of embodiments of the invention, taken in conjunction with the accompanying drawings of which.

DETAILED DESCRIPTION OF THE EMBODIMENTS

Figure 1:
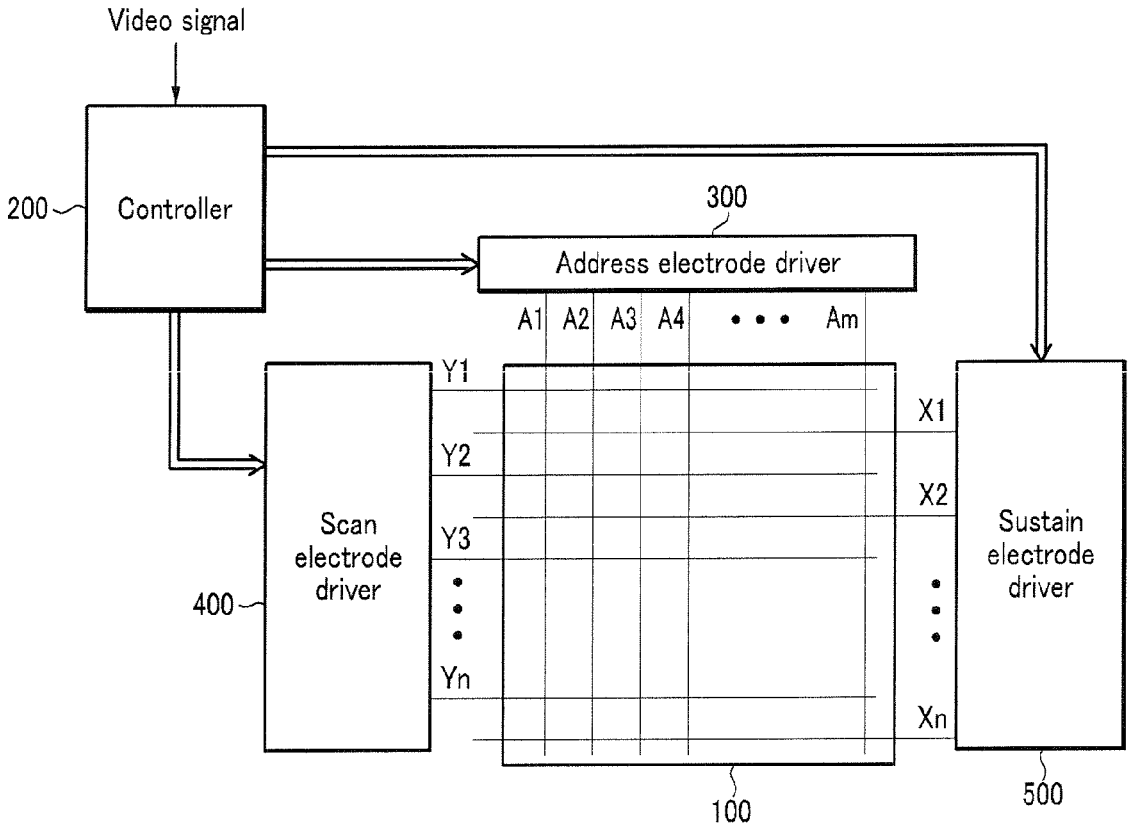
FIG. 1 shows a plasma display device according to an aspect of the invention.

Reference will now be made in detail to various embodiments of the invention, examples of which are shown in the accompanying drawings, wherein like reference numerals refer to like elements throughout. The embodiments are described below in order to explain the invention by referring to the drawings.

The term "wall charges" in the following description refers to charges that are formed and accumulated on a wall (e.g., a dielectric layer) near an electrode of a discharge cell. Although the wall charges do not actually touch the electrode, the wall charges will be described as being "formed" or "accumulated" on the electrode. The term "wall voltage" in the following description refers to a potential difference formed on the wall by the wall charges.

A plasma display device and a driving method thereof according to aspects of the invention will now be described in detail with reference to the drawings.

FIG. 1 shows a plasma display device according to an aspect of the invention.

As shown in FIG. 1, the plasma display device includes a plasma display panel (PDP) 100, a controller 200, an address electrode driver 300, a scan electrode driver 400, and a sustain electrode driver 500.

The plasma display panel (PDP) 100 includes a plurality of address electrodes (A1-Am, referred to as A) extending in the column direction, and a plurality of sustain electrodes (X1-Xn, referred to as X) and a plurality of scan electrodes (Y1-Yn, referred to as Y) arranged in pairs extending in the row direction. The sustain electrodes X1-Xn are formed to correspond to the scan electrodes Y1-Yn so that each of the sustain electrodes X1-Xn is paired with one of the scan electrodes Y1-Yn. In general, the sustain electrodes X1-Xn are connected in common at one end. The plasma display panel (PDP) 100 includes a substrate (not shown) on which the sustain and scan electrodes (X1-Xn, Y1-Yn) are arranged, and another substrate (not shown) on which the address electrodes A1-Am are arranged. The two substrates face with each other with a discharge space therebetween so that the scan electrodes Y1-Yn and the sustain electrodes X1-Xn cross the address electrodes A1-Am. Discharge cells are formed at intersections of the address electrodes A1-Am with the scan electrodes Y1-Yn and the sustain electrodes X1-Xn. Each of the discharge cells is located at a respective intersection where one of the address electrodes A1-Am crosses one of the scan electrodes Y1-Yn and one of the sustain electrodes X1-Xn. The above-described plasma display panel (PDP) 100 configuration is merely one example of a panel to which the invention is applicable, and the invention is also applicable to other types of panels to which driving waveforms to be subsequently described are applied.

The controller 200 receives a video signal and outputs an address electrode (A) drive control signal, a sustain electrode (X) drive control signal, and a scan electrode (Y) drive control signal. The controller 200 divides each frame of the video signal into a plurality of subfields for driving the plasma display panel 100, and each subfield has a reset period, an address period, and a sustain period. According to an aspect of the invention, the controller 200 alternately provides a sustain pulse applying period and a holding period in the sustain period of at least one subfield of the plurality of subfields when the input video signal is a video signal that expresses only grayscales less than a reference grayscale.

The address electrode driver 300 receives the address electrode (A) drive control signal from the controller 200 and applies a display data signal for selecting discharge cells to be displayed to the respective address electrodes A.

The scan electrode driver 400 receives the scan electrode (Y) drive control signal from the controller 200 and applies a driving voltage to the scan electrodes Y.

The sustain electrode driver 500 receives the sustain electrode (X) drive control signal from the controller 200 and applies a driving voltage to the sustain electrodes X.

Driving waveforms of a plasma display device according to aspects of the invention will now be described with reference to FIGS. 2 and 3. For better understanding and ease of description, driving waveforms applied to the scan electrode Y, the sustain electrode X, and the address electrode A forming one discharge cell will be described.

Figure 2:
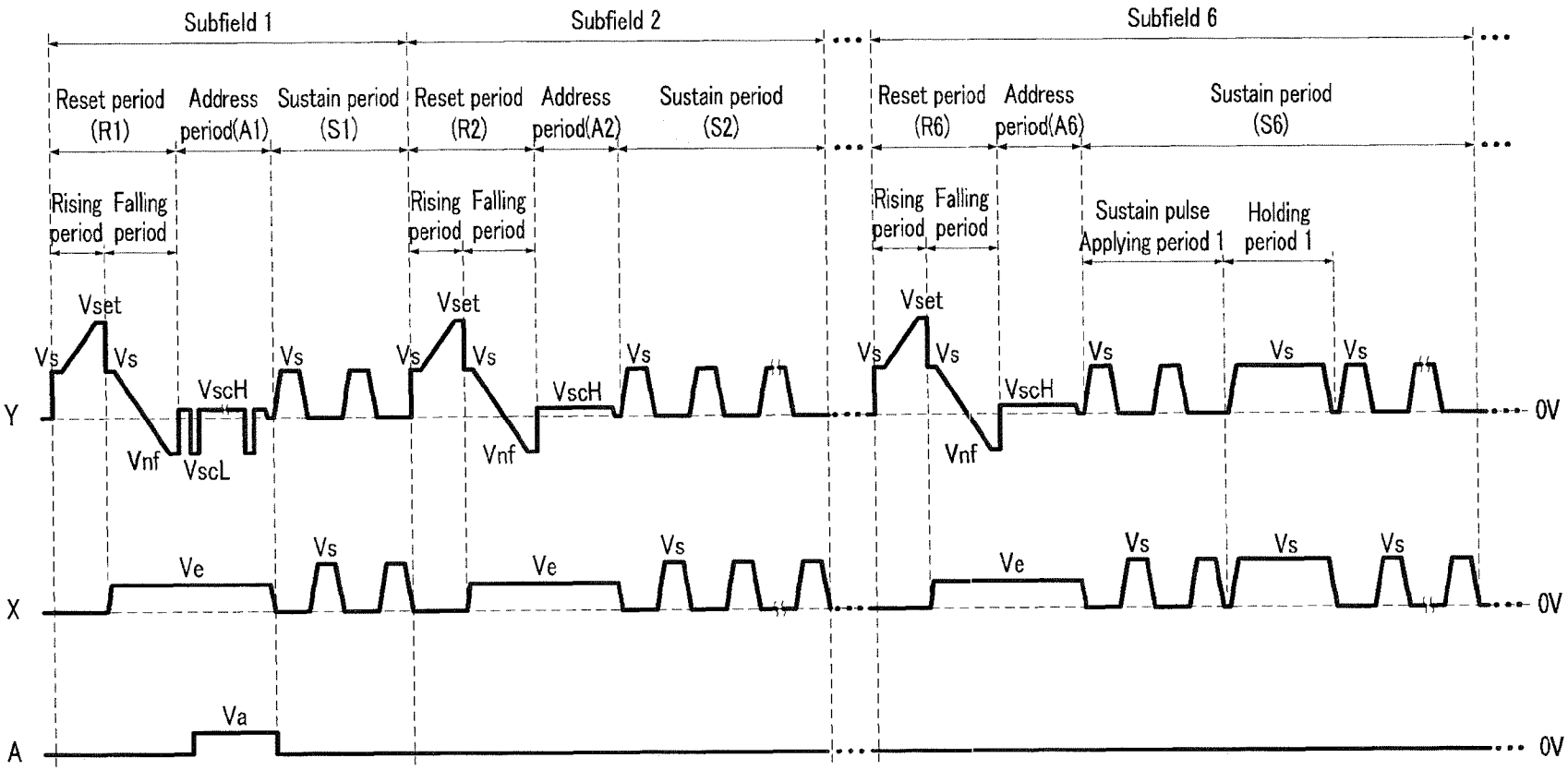
FIG. 2 shows driving waveforms of a plasma display device according to an aspect of the invention.

FIG. 2 shows driving waveforms of a plasma display device according to an aspect of the invention.

As shown in FIG. 2, each subfield of a plasma display device according to an aspect of the invention has a reset period, an address period, and a sustain period. Also, the reset period includes a rising period and a falling period. One frame is divided into a plurality of subfields having respective gray-scale weights, all of the discharge cells of the plasma display panel 100 are addressed in the subfield having the minimum weight, i.e., are selected as discharge cells that will be turned on in the subfield having the minimum weight, and all of the discharge cells of the plasma display panel 100 are not addressed in any of the other subfields, i.e., are not selected as discharge cells to be turned on in any of the other subfields. The subfield having the minimum weight will be referred to as a first subfield, and the other subfields will be referred to as n-th subfields according to their weights. FIG. 2 shows a first subfield, a second subfield, and a sixth subfield having a weight greater than the weights of the first and second subfields.

In the rising period of the reset period (R1) of the first subfield, the voltage at the scan electrode Y is gradually increased from the Vs voltage to the Vset voltage while the voltage at the sustain electrode X is maintained at the reference voltage (0V in FIG. 2). While the voltage at the scan electrode Y is being increased, a weak discharge is generated between the scan electrode Y and the sustain electrode X, and between the scan electrode Y and the address electrode A, which causes (−) wall charges to be formed on the scan electrode Y, and (+) wall charges to be formed on the sustain electrode X and the address electrode A. When the voltage at the scan electrode Y is gradually increased, a weak discharge is generated at the cell and wall charges are formed so that the sum of the externally applied voltage and the wall voltage of the cell may maintain the discharge firing voltage (Vf). Also, the Vset voltage is a voltage that is high enough to generate a reset discharge in the cell under any condition because the cells must be reset in the reset period.

In the falling period of the reset period (R1) of the first subfield, the voltage at the scan electrode Y is gradually decreased from the Vs voltage to the Vnf voltage while the voltage at the sustain electrode X is maintained at the Ve voltage. While the voltage at the scan electrode Y is being decreased, a weak discharge is generated between the scan electrode Y and the sustain electrode X, and between the scan electrode Y and the address electrode A, which causes the (−) wall charges that were formed on the scan electrode Y in the rising period and the (+) wall charges that were formed on the sustain electrode X and the address electrode A in the rising period to be erased. As a result, the (−) wall charges at the scan electrode Y are reduced and the (+) wall charges at the sustain electrode X and the address electrode A are reduced. In FIG. 2, the increasing or decreasing voltage at the scan electrode Y in the reset period is shown as having a ramp waveform, but it can have any gradually increasing or decreasing waveform, such as an RC waveform or a stepped waveform.

To select (address) the discharge cell to emit light in the first subfield, a scan pulse having the VscL voltage (the scan voltage) is sequentially applied to the scan electrodes Y while the Ve voltage is applied to the sustain electrode X in the address period (A1) of the first subfield. An address pulse having the Va voltage is applied to the address electrode A passing through the discharge cell to emit light from among a plurality of discharge cells formed by the scan electrode Y to which the VscL voltage is applied. An address discharge is generated between the address electrode A to which the Va voltage is applied and the scan electrode Y to which the VscL voltage is applied, and between the scan electrode Y to which the VscL voltage is applied and the sustain electrode X to which the Ve voltage is applied, so that (+) wall charges are formed on the scan electrode Y and (−) wall charges are formed on the address electrode A and the sustain electrode X. The VscH voltage (the non-scan voltage) that is greater than the VscL voltage is applied to the scan electrodes Y to which the VscL voltage is not currently being applied, and the reference voltage (0V) is applied to the address electrodes A of the discharge cells that are not selected.

A scan pulse is sequentially applied to all of the scan electrodes and an address pulse is sequentially applied to all of the address electrodes each time a scan pulse is applied to a different one of the scan electrodes in the address period (A1) of the first subfield so that all of the discharge cells are selected to be light emitting cells.

In the sustain period (S1) of the first subfield, sustain pulses alternately having a high level voltage (Vs voltage in FIG. 2) and a low level voltage (0V voltage in FIG. 2) are applied in opposite phases to the scan electrode Y and the sustain electrode X while the low level voltage (0V) is applied to the address electrode A. That is, the 0V voltage is applied to the sustain electrode X when the Vs voltage is applied to the scan electrode Y, and the 0V voltage is applied to the scan electrode Y when the Vs voltage is applied to the sustain electrode X. A sustain discharge is generated between the scan electrode Y and the sustain electrode X by the wall voltage formed between the scan electrode Y and the sustain electrode X by the wall charges formed by the address discharge and the applied Vs voltage. The process of applying the sustain pulses to the scan electrode Y and the sustain electrode X is repeated a number of times corresponding to the weight of the first subfield.

The wall charge states of all of the discharge cells are reset in the reset period (R2) of the second subfield following the first subfield. The driving waveforms applied to the electrodes in the reset period (R2) of the second subfield are the same as the driving waveforms applied to the electrodes in the reset period (R1) of the first subfield, and thus will not be described here.

In the address period (A2) of the second subfield, the non-scan voltage (VscH) is applied to the scan electrode Y and the reference voltage (0V) is applied to the address electrodes A while the Ve voltage is applied to the sustain electrode X. Accordingly, none of the discharge cells are selected as cells to be turned on in the second subfield. Therefore, the wall charge state of the electrodes after the reset period is the same as the wall charge state of the electrodes after the address period.

In the sustain period (S2) of the second subfield, sustain pulses alternately having the high level voltage (Vs) and the low level voltage (0V) are applied in opposite phases to the scan electrode Y and the sustain electrode X while the low level voltage (0V) is applied to the address electrode A as was done in the sustain period (S1) of the first subfield. The process of applying sustain pulses to the scan electrode Y and the sustain electrode X is repeated a number of times corresponding to the weight of the second subfield.

Driving waveforms are applied in the third to fifth subfields in the same manner in which driving waveforms were applied in the second subfield. The number of sustain pulses applied in the sustain period of each of the third to fifth subfields corresponds to the weight of each of these subfields.

As shown in FIG. 2, a first sustain pulse applying period and a first holding period are alternately provided in the sustain period (S6) of the sixth subfield. Sustain pulses alternately having a high level voltage (Vs) and a low level voltage (0V) are applied in opposite phases to the scan electrode Y and the sustain electrode X during the first sustain pulse applying period. A high level voltage (Vs) is applied to the scan electrode Y and the sustain electrode X during the first holding period following the first sustain pulse applying period. The reference voltage (0V) is applied to the address electrode A during the sustain period (S6) of the sixth subfield. Also, since no address discharge was generated in the address period (A6), the wall charge state of the electrodes after the address period (A6) is the same as the wall charge state of the electrodes after the reset period (R6), and therefore no sustain discharge is generated between the scan electrode Y and the sustain electrode X in the first sustain pulse applying period and the first holding period.

Accordingly, the number of switching operations for applying a high level voltage (Vs) and a low level voltage (0V) to the scan electrode Y and the sustain electrode X can be reduced by performing a holding period for applying a high level voltage (Vs) to the scan electrode Y and the sustain electrode X in a subfield in which none of the discharge cells are selected as cells to be turned on. This reduces power consumption.

In the aspect of the invention described above, the sustain pulse applying period and the holding period are alternately provided in a subfield in which no sustain discharge is generated in any of the discharge cells. Also, it is possible to alternately provide the sustain pulse applying period and the holding period a plurality of times in the subfield. In addition, it is possible to provide the sustain pulse applying period and the holding period a plurality of times according to the weight of the subfield. Accordingly, the more times the holding period is provided in the subfield, the more power consumption is reduced since the number of switching operations of the scan electrode Y and the sustain electrode X is reduced. Also, the reactive power that is consumed in the process of applying a high level voltage (Vs) and a low level voltage (0V) to the scan electrode Y and the sustain electrode X in the sustain period is reduced.

It is preferable to alternately provide the sustain pulse applying period and the holding period rather than simply performing the holding period for a long time. Also, it is desirable to a sustain pulse applying period before the reset period of the subfield following the sustain period of the subfield in which no sustain discharge is generated in any of the discharge cells, because space charges in the plasma display panel 100 can be reduced when the high level voltage (Vs) is applied to the scan electrode Y and the sustain electrode X in the holding period and this state in which there is no voltage difference between these two electrodes is maintained for a long time. Therefore, a stable reset operation can be performed in the reset period of the next subfield by alternately providing the holding period and the sustain pulse applying period in the current subfield, and then providing a sustain pulse applying period in the current subfield before the reset period of the next subfield.

Also, it is desirable to alternately provide a sustain pulse applying period and a holding period in a subfield having a high grayscale weight, because this can reduce power consumption more efficiently since the number of sustain pulses that are applied in the sustain period of the subfield having a high grayscale weight is greater than the number of sustain pulses that are applied in the sustain field of a subfield having a low grayscale weight.

Figure 3:
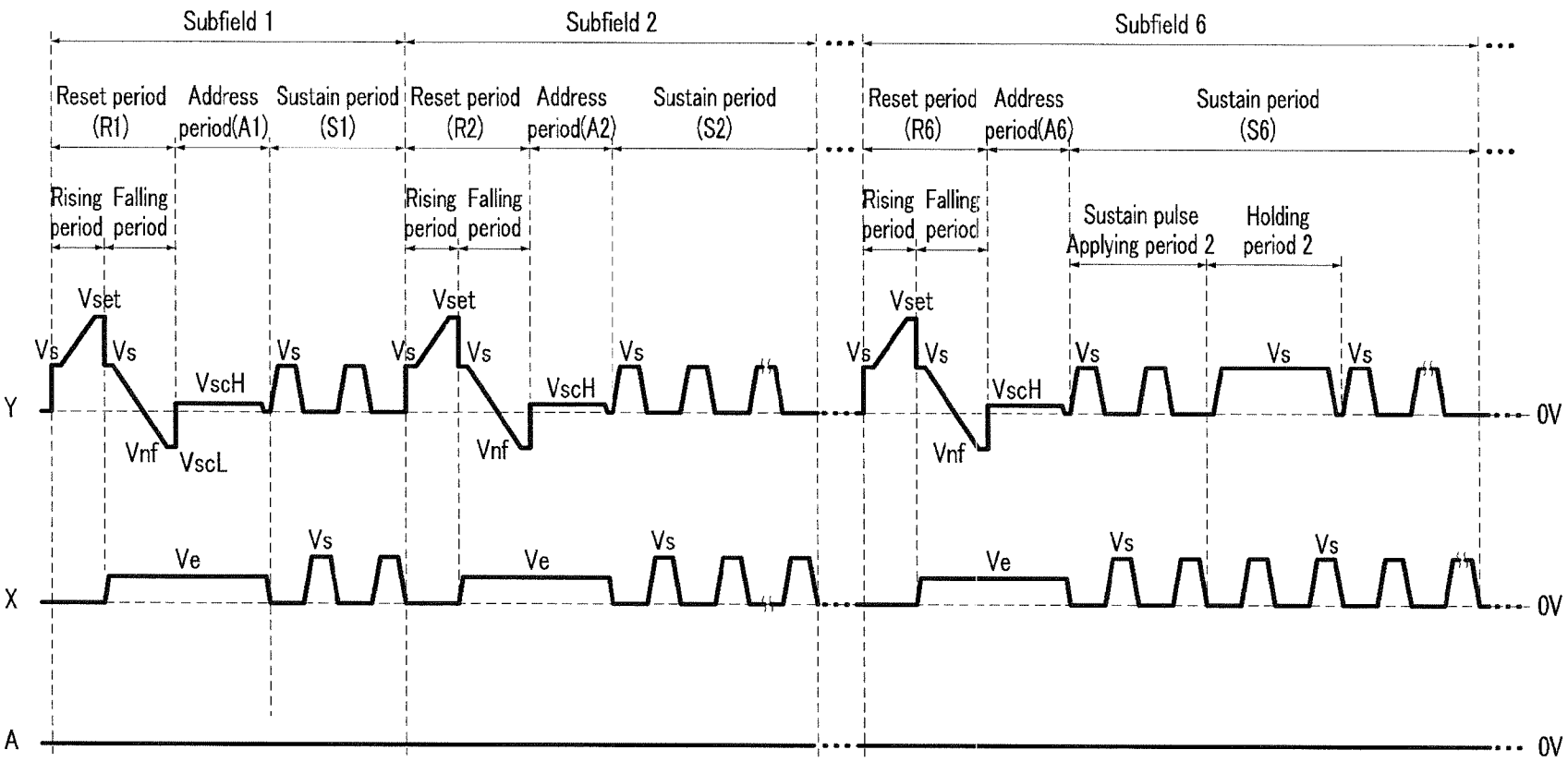
FIG. 3 shows driving waveforms of a plasma display device according to an aspect of the invention.

FIG. 3 shows driving waveforms of a plasma display device according to an aspect of the invention.

In this aspect of the invention, the driving waveforms are for displaying a completely black screen in which none of the discharge cells are addressed in the subfield having the minimum weight or in any other subfield, and thus differ from the driving waveforms shown in FIG. 2 in which all of the discharge cells are addressed in the subfield having the minimum weight. The subfield having the minimum weight will be referred to as a first subfield, and other subfields will be referred to as n-th subfields according to their weights. FIG. 3 shows a first subfield, a second subfield, and a sixth subfield having a weight greater than the weights of the first and second subfields.

As shown in FIG. 3, the plasma display device applies driving waveforms in a reset period, an address period, and a sustain period in each of the subfields. Descriptions of the portions of the driving waveforms in FIG. 3 that are the same as the corresponding portions of the driving waveforms in FIG. 2 will not be repeated here. The difference between the driving waveforms in FIG. 3 and the driving waveforms in FIG. 2 is that in the driving waveforms in FIG. 3, the address operation is not performed in any of the discharge cells in the address period of the first subfield, and different voltage waveforms are applied to the scan electrode Y and the sustain electrode X in the sustain period of the sixth subfield.

In the address period (A1) of the first subfield, the reference voltage (0V) is applied to the address electrode A and the non-scan voltage (VscH) is applied to the scan electrode Y while the Ve voltage is applied to the sustain electrode X. That is, none of the discharge cells are selected as cells to be turned on in the first subfield.

In the sustain period (S1) of the first subfield, a sustain pulse alternately having a high level voltage (Vs) and a low level voltage (0V) is applied in opposite phases to the scan electrode Y and the sustain electrode X. The process of applying sustain pulses to the scan electrode Y and the sustain electrode X is repeated a number of times corresponding to the weight of the first subfield.

Driving waveforms are applied in the second to fifth subfields in the same manner in which the driving waveforms were applied in the first subfield. The number of sustain pulses applied in the sustain period of each of the second to fifth subfields corresponds to the weight of each of these subfields.

As shown in FIG. 3, a second sustain pulse applying period and a second holding period are alternately provided in the sustain period (S6) of the sixth subfield. In the second sustain pulse applying period, sustain pulses alternately having a high level voltage (Vs) and a low level voltage (0V) are applied in opposite phases to the scan electrode Y and the sustain electrode X. In the second holding period following the second sustain pulse applying period, the high level voltage (Vs) is applied to the scan electrode Y, and sustain pulses are applied to the sustain electrode X just like in the second sustain pulse applying period.

In FIG. 3, the high level voltage (Vs) is applied to the scan electrode Y in the second holding period to reduce the number of switching operations for applying a high level voltage (Vs) and a low level voltage (0V) to the scan electrode Y. Alternatively, the high level voltage (Vs) can be applied to the sustain electrode X while the sustain pulses are applied to the scan electrode Y in the second holding period. Also, the second sustain pulse applying period and the second holding period can be alternately provided a plurality of times. Furthermore, if this is done, the electrode to which the high level voltage (Vs) is applied and the electrode to which the sustain pulses is applied can be alternately switched in the second holding periods. That is, the high level voltage (Vs) can be applied to the scan electrode Y while the sustain pulses are applied to the sustain electrode X in a first one of the second holding periods after a first one of the second sustain pulse applying periods, and the high level voltage (Vs) can be applied to the sustain electrode X while the sustain pulses are applied to the scan electrode Y in a second one of the second holding periods after a second one of the second sustain pulse applying periods.

Accordingly, the effect of reducing power consumption obtained in the first holding period described in FIG. 2 can be also obtained in the second holding period described in FIG. 3. Also, applying the sustain pulses to the scan electrode Y or the sustain electrode X in the second holding period described in FIG. 3 can prevent the loss of priming particles that can occur when the voltage difference between the two electrodes is 0 as it is in the first holding period described in FIG. 2.

In the aspects of the invention described above in connection with FIGS. 2 and 3, the sustain pulse applying period and the holding period are alternately provided in the sixth subfield. However, it is also possible to alternately provide the sustain pulse applying period and the holding period in at least one other subfield having a weight greater than a reference weight in addition to the sixth subfield, for example, in at least one of the second to fifth subfields in FIGS. 2 and 3, and/or in at least one of seventh, eighth, . . . subfields that may follow the sixth subfield as indicated by the ellipses " . . . " following the sixth subfield in FIGS. 2 and 3. The actual subfield or subfields in which the sustain pulse applying period and the holding period are alternately provided will depend on the reference weight that is selected. For example, if there are eight subfields having respective weights of 1, 2, 4, 8, 16, 32, 64, and 128 that can be combined to represent grayscales ranging from 0 to 255 and the reference weight is selected to be 8, then the sustain pulse applying period and the holding period can be provided in one or more of the fifth, sixth, seventh, and eighth subfields having respective weights of 16, 32, 64, and 128.

In the aspect of the invention described above in connection with FIG. 2, the sustain pulse applying period and the holding period are alternately provided in the sixth subfield when all of the discharge cells are addressed in the first subfield having the minimum weight. In the aspect of the invention described above in connection with FIG. 3, the sustain pulse applying period and the holding period are alternately provided in the sixth subfield when displaying a completely black screen in which none of the discharge cells are addressed in any of the subfields. However, these are merely two examples to which the invention may be applied, and it is also possible to alternately provide the sustain pulse applying period and the holding period in at least one subfield having a weight greater than a reference weight when displaying one frame of an image expressing only grayscales less than a reference grayscale. If the first subfield in FIGS. 2 and 3 has a weight of 1, then the reference grayscale in the case of FIG. 2 may be 2, and the reference grayscale in the case of FIG. 3 may be 1. If the reference grayscale is 8, for example, then the sustain pulse applying period and the holding period are alternately provided in at least one subfield having a weight greater than the reference weight if all of the discharge cells have a grayscale less than the reference grayscale of 8. In this case, the discharge cells can have different grayscales as long as all of the grayscales are less than the reference grayscale of 8.

Also, the first holding period shown in FIG. 2 can be replaced by the second holding period shown in FIG. 3, and the second holding period shown in FIG. 3 can be replaced by the first holding period shown in FIG. 1. Also, the first holding period and the second holding period can be provided in one subfield. For example, the first holding period and second holding period can be alternately provided in one subfield. One example of this is providing, in a sustain period of one subfield, a sustain pulse applying period, followed by a first holding period, followed by a sustain pulse applying period, followed by a second holding period, followed by a sustain pulse applying period, followed by a reset period of a next subfield.

Figure 4:
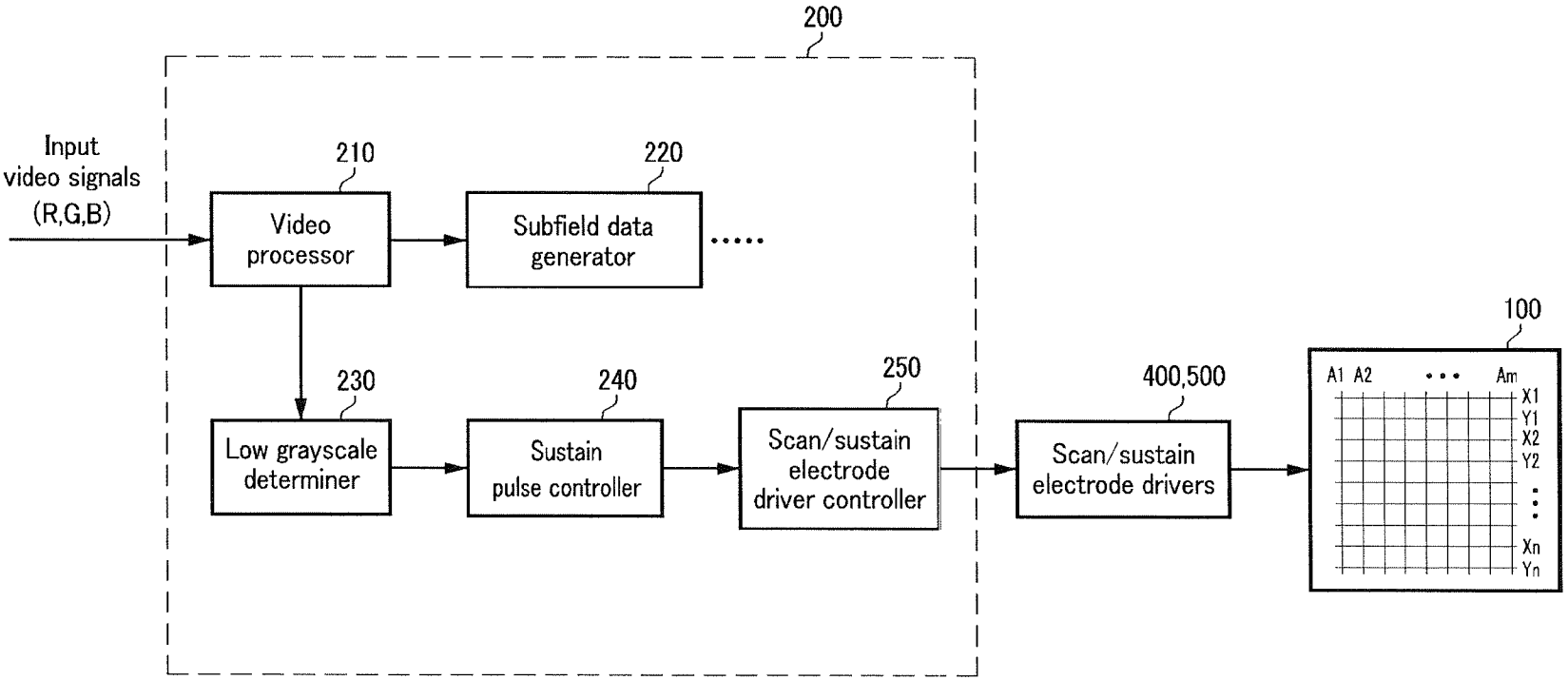
FIG. 4 shows a block diagram of a controller of a plasma display device according to an aspect of the invention.

Referring to FIG. 4, a controller to apply driving waveforms for alternately providing a sustain pulse applying period and a holding period to the plasma display panel 100 when displaying one frame of an image that expresses only grayscales less than a reference grayscale according to an aspect of the invention will now be described.

FIG. 4 shows a block diagram of a controller of a plasma display device according to an aspect of the invention.

As shown in FIG. 4, the controller 200 includes a video processor 210, a subfield data generator 220, a low grayscale determiner 230, a sustain pulse controller 240, and a scan/sustain electrode driver controller 250.

The video processor 210 maps i-bit image data obtained from RGB input video signals to corrected j-bit (j>i) image data in accordance with an inverse gamma curve, performs error diffusion to adjacent pixels using the low j-i bits of the corrected j-bit image data to generate error-diffused image data, and transmits the error-diffused image data to the subfield data generator 220 and the low grayscale determiner 230. The RGB input video signals input to the video processor 210 are digital video signals, and if analog video signals are input to the plasma display device, it is necessary to convert the analog video signals to digital video signals using an analog-to-digital converter (not shown).

The subfield data generator 220 generates subfield data specifying whether each one of the discharge cells is to be turned on or turned off in each one of the subfields based on the error-diffused image data transmitted from the video processor 210, and transmits the subfield data to an address data generator (not shown) and a sustain pulse number generator (not shown) that generate controls signals to control the address electrode driver 300 (shown in FIG. 1 but not shown in FIG. 4) and the scan/sustain electrode drivers 400 and 500 to generate driving waveforms to display the RGB input video signals on the plasma display panel (PDP) 100.

The RGB input video signals include a plurality of frames, and the low grayscale determiner 230 determines whether a current frame of the RGB input video signals expresses only grayscales less than a reference grayscale from the error-diffused image data transmitted from the video processor 210, and transmits a control signal indicative of the determination to the sustain pulse controller 240.

In greater detail, the low grayscale determiner 230 detects the grayscales of all of the discharge cells of the plasma display panel 100 for the current frame of the RGB input video signals from the error-diffused image data transmitted from the video processor 210. The low grayscale determiner 230 determines that the current frame of the RGB input video signals expresses only grayscales less than the reference grayscale when all of the grayscales of the discharge cells are less than the reference grayscale. The low grayscale determiner 230 transmits a control signal indicative of the determination to the sustain pulse controller 240.

The reference grayscale is a grayscale that can be expressed by a combination of subfields having low weights. For example, if there are eight subfields having respective weights of 1, 2, 4, 8, 16, 32, 64, and 128 that can be combined to represent grayscales ranging from 0 to 255, the reference grayscale can be 1 to determine whether the current frame is a completely black frame in which all of the discharge cells express a 0 grayscale, or can be 2 to determine whether all of the discharge cells express a grayscale of 1, i.e., whether all of the discharge cells are turned on only in the subfield having the minimum weight of 1.

The sustain pulse controller 240 generates a sustain pulse control signal to alternately provide a sustain pulse applying period and a holding period in the sustain period of at least one subfield when the control signal transmitted from the low grayscale determiner 230 indicates that the current frame has been determined to be a frame that expresses only grayscales less than the reference grayscale, and transmits the sustain pulse control signal to the scan/sustain driver controller 250.

In greater detail, the sustain pulse controller 240 generates a sustain pulse control signal to alternately provide a sustain pulse applying period and a holding period in the sustain period of at least one subfield having a weight greater than a reference weight when the control signal transmitted from the low grayscale determiner 230 indicates that the current frame expresses only grayscales less than the reference grayscale. The reference weight is selected so that each of the at least one subfield having a weight greater than the reference weight has a relatively high weight and a relatively long sustain period, such as the sixth subfield as shown in FIGS. 2 and 3.

The sustain period of a subfield having a relatively high weight is relatively long, and thus the number of times that sustain pulses alternately having a high level voltage (Vs) and a low level voltage (0V) are applied to the scan electrode Y and the sustain electrode X in such a subfield is greater than the number of times the sustain pulses are applied to the scan electrode Y and the sustain electrode X in a subfield having a relatively low weight and a relatively short sustain period. Hence, in the sustain period of the subfield having the relatively high weight, the number of switching operations for applying sustain pulses to the two electrodes and a reactive power consumption associated with the switching operations are greater than in the sustain period of the subfield having the relatively low weight. Accordingly, power consumption can be further reduced by alternately providing the sustain pulse applying period and the holding period in the sustain period of a subfield having a weight greater than the reference weight.

Also, the sustain pulse controller 240 transmits the sustain pulse control signal o the scan/sustain electrode driver controller 250. The sustain pulse control signal is a control signal to alternately provide the sustain pulse applying period and the holding period in the sustain period of the at least one subfield having a weight greater than the reference weight as shown, for example, in FIG. 2 or FIG. 3.

The scan/sustain electrode driver controller 250 controls the scan/sustain electrode drivers 400 and 500 according to the control signal transmitted from the sustain pulse controller 240 to generate and apply driving waveforms to the plasma display panel (PDP) 100 to display the RGB input video signals as shown, for example, in FIG. 2 or FIG. 3.

While it has been described that the high level voltage (Vs) is applied to the scan electrode Y and/or the sustain electrode X during the holding period in the above embodiments, the low level voltage (0V) instead of the high level voltage (Vs) can be applied to the scan electrode Y and/or the sustain electrode X during the holding period.

As described above, according to aspects of the invention, when a current frame of a video signal expresses only grayscales less than a reference grayscale, a sustain pulse applying period and a holding period are alternately provided in a sustain period of at least one subfield having a weight greater than a reference weight in all of the discharge cells of a plasma display panel, thereby reducing power consumption in the plasma display panel.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. A method of driving a plasma display device, the plasma display device comprising a plasma display panel, the plasma display panel comprising a plurality of first electrodes, a plurality of second electrodes extending in a same direction as the first electrodes, a plurality of third electrodes crossing the first electrodes and the second electrodes, and a plurality of discharge cells, each of the discharge cells being located at a respective intersection where one of the third electrodes crosses one of the first electrodes and one of the second electrodes, the method comprising:

receiving a video signal comprising a plurality of frames;

dividing each of the frames of the video signal into a plurality of subfields having respective grayscale weights, each of the subfields comprising a reset period, an address period, and a sustain period;

determining whether one of the frames of the video signal expresses only grayscales less than a reference grayscale; and when the one of the frames of the video signal expresses only grayscales less than the reference grayscale, performing a sustain pulse applying operation on the first electrodes and the second electrodes in at least one sustain pulse applying period in the sustain period of at least one of the subfields of the one of the frames of the video signal, and after performing the sustain pulse applying operation, performing a holding operation on the first electrodes and the second electrodes in at least one holding period in the sustain period of the at least one of the subfields of the one of the frames of the video signal, wherein the holding operation comprises maintaining the first electrodes and/or the second electrodes at a predetermined voltage in the at least one holding period, wherein the at least one of the subfields of the one of the frames of the video signal has a weight greater than a reference weight, and wherein the sustain period of the at least one of the subfields having a weight greater than the reference weight comprises a plurality of sustain pulse applying periods and at least one holding period arranged so that the sustain period of the at least one of the subfields having a weight greater than the reference weight begins with a first one of the sustain pulse applying periods and ends with a last one of the sustain pulse applying periods, and each one of the sustain pulse applying periods is followed by one of the at least one holding period except for the last one of the sustain pulse applying periods.

2. The method of claim 1, wherein the sustain pulse applying operation comprises applying sustain pulses alternately having a first voltage and a second voltage less than the first voltage in opposite phases to the first electrodes and the second electrodes in the at least one sustain pulse applying period; and wherein the maintaining of the first electrodes and/or the second electrodes at the predetermined voltage comprises maintaining the first electrodes and the second electrodes at the first voltage in the at least one holding period.

3. The method of claim 1, wherein the sustain pulse applying operation comprises applying sustain pulses alternately having a first voltage and a second voltage less than the first voltage in opposite phases to the first electrodes and the second electrodes in the at least one sustain pulse applying period; and wherein the maintaining of the first electrodes and/or the second electrodes at the predetermined voltage comprises either maintaining the first electrodes at the first voltage in the at least one holding period while applying sustain pulses alternatively having the first voltage and the second voltage to the second electrodes in the at least one holding period, or maintaining the second electrodes at the first voltage in the at least one holding period while applying sustain pulses alternately having the first voltage and the second voltage to the first electrodes in the at least one holding period.

4. The method of claim 1, wherein a last sustain pulse applying period of the at least one sustain pulse applying period follows a last holding period of the at least one holding period, and precedes the reset period of a next one of the subfields of the video signal.

5. The method of claim 1, wherein the determining of whether one of the frames of the video signal expresses only grayscales less than a reference grayscale comprises:

detecting grayscales of all of the discharge cells from the video signal; and determining that one frame of the video expresses only grayscales less than the reference grayscale when the grayscales of all of the discharge cells in the one frame of the video signal are less than the reference grayscale.

6. The method of claim 5, wherein the determining that one frame of the video signal expresses only grayscales less than the reference grayscale comprises determining that one frame of the video signal expresses only grayscales less than the reference grayscale when the grayscales of all of the discharge cells in the one frame of the video signal indicate that all of the discharge cells in the one frame of the video signal are to be turned on only in one of the subfields having a minimum weight.

7. The method of claim 5, wherein the determining that one frame of the video signal expresses only grayscales less than the reference grayscale comprises determining that one frame of the video signal expresses only grayscales less than the reference grayscale when the grayscales of all of the discharge cells in the one frame of the video signal indicate that none of the discharge cells in the one frame of the video signal are to be turned on in any of the subfields.

8. The method of claim 1, wherein the sustain pulse applying operation comprises applying sustain pulses alternately having a first voltage and a second voltage less than the first voltage in opposite phases to the first electrodes and the second electrodes in the at least one sustain pulse applying period;

wherein the predetermined voltage is the first voltage; and wherein the first voltage is a high level voltage of the sustain pulses.

9. A plasma display device comprising:

a plasma display panel comprising:

a plurality of first electrodes;

a plurality of second electrodes extending in a same direction as the first electrodes;

a plurality of third electrodes crossing the first electrodes and the second electrodes; and a plurality of discharge cells, each of the discharge cells being located at a respective crossing region where one of the third electrodes crosses one of the first electrodes and one of the second electrodes;

a controller to receive a video signal comprising a plurality of frames, to divide each of the frames of the video signal into a plurality of subfields having respective grayscale weights, each of the subfields comprising a reset period, an address period, and a sustain period, and to output control signals to perform a reset operation in the reset period of each of the subfields in accordance with the video signal, to perform an address operation in the address period of each of the subfields in accordance with the video signal, and to perform a sustain operation in the sustain period of each of the subfields in accordance with the video signal; and a driver to drive the plasma display panel according to the control signals output by the controller, wherein the controller is configured, when one of the frames of the video signal expresses only grayscales less than a reference grayscale, to output a control signal to perform a sustain pulse applying operation in at least one sustain pulse applying period in the sustain period of at least one of the subfields of the one of the frames of the video signal, and after performing the sustain pulse applying operation, to perform a holding operation in at least one holding period in the sustain period of the at least one of the subfields of the one of the frames of the video signal, wherein the sustain pulse applying operation comprises applying sustain pulses alternately having a first voltage and a second voltage less than the first voltage in opposite phases to the first electrodes and the second electrodes in the at least one sustain pulse applying period, wherein the holding operation comprises maintaining the first electrodes and/or the second electrodes at the first voltage in the at least one holding period, wherein the at least one of the subfields of the one of the frames of the video signal has a weight greater than a reference weight, and wherein the sustain period of the at least one of the subfields having a weight greater than the reference weight comprises a plurality of sustain pulse applying periods and at least one holding period arranged so that the sustain period of the at least one of the subfields having a weight greater than the reference weight begins with a first one of the sustain pulse applying periods and ends with a last one of the sustain pulse applying periods, and each one of the sustain pulse applying periods is followed by one of the at least one holding period except for the last one of the sustain pulse applying periods.

10. The plasma display device of claim 9, wherein the controller comprises:

a low grayscale determiner to determine whether one of the frames of the video signal expresses only grayscales less than the reference grayscale, and a sustain pulse controller to output the control signal to perform the sustain pulse applying operation and the holding operation when the low grayscale determiner determines that one of the frames of the video signal expresses only grayscales less than the reference grayscale.

11. The plasma display device of claim 10, wherein the holding operation comprises maintaining the first electrodes and the second electrodes at the first voltage in the at least one holding period.

12. The plasma display device of claim 11, wherein the holding operation comprises either maintaining the first electrodes at the first voltage in the at least one holding period while applying sustain pulses alternately having the first voltage and the second voltage to the second electrodes in the at least one holding period, or maintaining the second electrodes at the first voltage in the at least one holding period while applying sustain pulses alternately having the first voltage and the second voltage to the first electrodes in the at least one holding period.

13. The plasma display device of claim 10, wherein a last sustain pulse applying period of the at least one sustain pulse applying period follows a last holding period of the at least one holding period, and precedes the reset period of a next one of the subfields of the video signal.

14. The plasma display device of claim 10, wherein the low grayscale determiner detects grayscales of all of the discharge cells from the video signal, and determines that one frame of the video signal expresses only grayscales less than the reference grayscale when the grayscales of all of the discharge cells in the one frame of the video signal are less than the reference grayscale.

15. The plasma display device of claim 10, wherein the first voltage is a high level voltage of the sustain pulses.

16. A plasma display device comprising:

a plasma display panel comprising:

a plurality of first electrodes;

a plurality of second electrodes extending in a same direction as the first electrodes;

a plurality of third electrodes crossing the first electrodes and the second electrodes; and a plurality of discharge cells, each of the discharge cells being located at a respective crossing region where one of the third electrodes crosses one of the first electrodes and one of the second electrodes; and a plasma panel driving circuit to receive a video signal comprising a plurality of frames, to divide each of the frames of the video signal into a plurality of subfields having respective grayscale weights, each of the subfields comprising a reset period, an address period following the reset period, and a sustain period following the address period, and to output driving waveforms to drive the first electrodes, the second electrodes, and the third electrodes of the plasma display panel in the reset period, the address period, and the sustain period of each of the subfields to display the video signal, wherein when a current frame of the video signal expresses only grayscales less than a reference grayscale, the sustain period of at least one of the subfields having a weight greater than a reference weight comprises:

at least one sustain pulse applying period in which sustain pulses having opposite phases are applied to the first electrodes and the second electrodes; and at least one holding period in which a predetermined voltage is applied to the first electrodes and/or the second electrodes, wherein one of the at least one sustain pulse applying period precedes each of the at least one holding period in a same subfield, and wherein the sustain period of the at least one of the subfields having a weight greater than the reference weight comprises a plurality of sustain pulse applying periods and at least one holding period arranged so that the sustain period of the at least one of the subfields having a weight greater than the reference weight begins with a first one of the sustain pulse applying periods and ends with a last one of the sustain pulse applying periods, and each one of the sustain pulse applying periods is followed by one of the at least one holding period except for the last one of the sustain pulse applying periods.

17. The plasma display device of claim 16, wherein in the at least one holding period, the predetermined voltage is applied to the first electrodes and the second electrodes.

18. The plasma display device of claim 16, wherein in the at least one holding period, the predetermined voltage is applied to the first electrodes and sustain pulses are applied to the second electrodes, or the predetermined voltage is applied to the second electrodes and sustain pulses are applied to the first electrodes.

* * * * *

UNITED STATES PATENT AND TRADEMARK OFFICE

CERTIFICATE OF CORRECTION

PATENT NO. : 8,031,137 B2
APPLICATION NO. : 11/776910
DATED : October 4, 2011
INVENTOR(S) : Tae-Kyoung Kang It is certified that error appears in the above-identified patent and that said Letters Patent is hereby corrected as shown below:

In the Claims

Column 15, Claim 12, line 14. Delete "11,"

Insert -- 10, --

Signed and Sealed this
Twenty-eighth Day of August, 2012

David J. Kappos

David J. Kappos
*Director of the United States Patent and Trademark Office*